US011484897B2

(12) United States Patent
Yuan

(10) Patent No.: US 11,484,897 B2
(45) Date of Patent: Nov. 1, 2022

(54) PORTABLE WATER SPRAYING DEVICE

(71) Applicant: SHENZHEN JUNLIAN E-COMMERCE CO., LTD., Shenzhen (CN)

(72) Inventor: Weijian Yuan, Shenzhen (CN)

( * ) Notice: Subject to any disclaimer, the term of this patent is extended or adjusted under 35 U.S.C. 154(b) by 338 days.

(21) Appl. No.: 16/849,053

(22) Filed: Apr. 15, 2020

(65) Prior Publication Data

US 2021/0323011 A1 Oct. 21, 2021

(51) Int. Cl.

| | |
|---|---|
| ***B05B 9/03*** | (2006.01) |
| ***A63G 31/00*** | (2006.01) |
| ***B05B 1/20*** | (2006.01) |
| ***B05B 15/625*** | (2018.01) |

(52) U.S. Cl.

CPC ..... *B05B 9/035* (2013.01); *A63G 31/007* (2013.01); *B05B 1/207* (2013.01); *B05B 15/625* (2018.02)

(58) Field of Classification Search

CPC ..... B05B 9/035; B05B 1/207; B05B 15/625; A63G 31/007

See application file for complete search history.

(56) References Cited

U.S. PATENT DOCUMENTS

| | | | | |
|---|---|---|---|---|
| 3,636,268 A * | 1/1972 | Stiles | H04M 9/001 379/172 |
| 4,651,360 A * | 3/1987 | Wang | B63B 7/08 4/588 |
| 10,610,794 B1 * | 4/2020 | Ruggiero | A63G 31/007 |
| 2018/0280814 A1 * | 10/2018 | Huang | A63G 21/18 |

* cited by examiner

*Primary Examiner* — Michael D Dennis

(57) ABSTRACT

A portable water spraying device includes a water conduit and a strut member. The water conduit defines an inflatable volume for receiving water. The water conduit includes a water inlet valve and a plurality of spray heads. The water inlet valve and the plurality of spray heads connect to the inflatable volume. The strut member is located adjacent to the water conduit and extends along an extension of the water conduit. The strut member is capable of keeping the water conduit stable when the water is pressured into the inflatable volume from the water inlet and is sprayed out form the plurality of spray heads.

3 Claims, 5 Drawing Sheets

PORTABLE WATER SPRAYING DEVICE

FIELD OF THE INVENTION

The present disclosure relates to the field of spraying devices, and in particular, it relates to a portable water spraying device.

BACKGROUND OF THE INVENTION

Water spraying devices are used for enabling kids to play in the water or for massage and relaxation. The conventional water spraying devices can be difficult to store or transport because they have awkward sizes and shapes. Such devices are difficult and awkward to handle or carry even for short distances. Some spraying devices may be unsecured and inflatable, and can be expanded when filled with water. However, the spray direction of these spraying devices is unstable when it is in use.

SUMMARY OF THE INVENTION

The technical problem to be solved by the present invention is to provide a portable water spraying device, which can be inflatable and the spray direction is stable.

In order to solve the above technical problem, one embodiment of the invention provides the following technical solution:

A portable water spraying device, includes a water conduit and a strut member. The water conduit defines an inflatable volume for receiving water. The water conduit includes a water inlet valve and a plurality of spray heads. The water inlet valve and the plurality of spray heads connect to the inflatable volume. The strut member is located adjacent to the water conduit and extends along an extension of the water conduit. The strut member is capable of keeping the water conduit stable when the water is pressured into the inflatable volume from the water inlet and is sprayed out form the plurality of spray heads.

As a preferred technical solution of the embodiment of the invention, the water conduit is a ring.

As a preferred technical solution of the embodiment of the invention, a cross-section of the water conduit is substantially semicircular when the water conduit is filled with water.

As a preferred technical solution of the embodiment of the invention, the plurality of spay heads is arrayed at a top portion of the water conduit, and is spaced along a circular extension of water conduit.

As a preferred technical solution of the embodiment of the invention, the strut member comprises an air conduit, and the air conduit is inflatable.

As a preferred technical solution of the embodiment of the invention, the air conduit is a ring around an outer side of the water conduit, and a bottom of the water conduit and a bottom of the air conduit are located at a same plane.

As a preferred technical solution of the embodiment of the invention, a cross-section of the air conduit is substantially semicircular when the air conduit is filling with air.

As a preferred technical solution of the embodiment of the invention, a ratio of a diameter of the semicircular of the cross-section of the air conduit and a diameter of the semicircular of the cross-section of the water conduit is about 1:2.

As a preferred technical solution of the embodiment of the invention, the diameter of the of the semicircular of the cross-section of the air conduit is about 50 millimeters, and the diameter of the semicircular of the cross-section of the water conduit is about 100 millimeters.

As a preferred technical solution of the embodiment of the invention, a diameter of each of the plurality of spray heads is about 1 millimeter.

In the embodiment above, the portable water spraying device includes a water conduit and a strut member. The strut member is positioned adjacent the water conduit adapted to support the water conduit. When the water is pressured into the water conduit and is sprayed out form the plurality of spray heads, the flowing water in the inflatable volume can be stable with strut member.

In the embodiment above, the air conduit is preferred, and can be located around the water conduit. The air conduit can support from outer surrounding of the water conduit. Thus, an outer side of the water conduit is stabled and cannot be easily deformed. However, an inner side of the water conduit is suppled, water flow sprayed from the water conduit can be deflected towards an inner side of the water conduit. So that, all water flow from the plurality of spray heads is sprayed towards a central of the water conduit and may fall to the floor. Even if the inner side of the water conduit is deformed or vibrated, the water flow can still be sprayed toward the inner side of the water conduit. The portable water spraying device have good compatibility, reliability, and stability.

BRIEF DESCRIPTION OF THE DRAWINGS

The drawings are used for providing further understanding of the present invention, constitute a part of the description and are used for explaining the present invention together with the embodiment of the present invention, but do not constitute a limitation to the present invention. In the drawings.

DETAILED DESCRIPTION OF THE EMBODIMENTS

Figure 1:
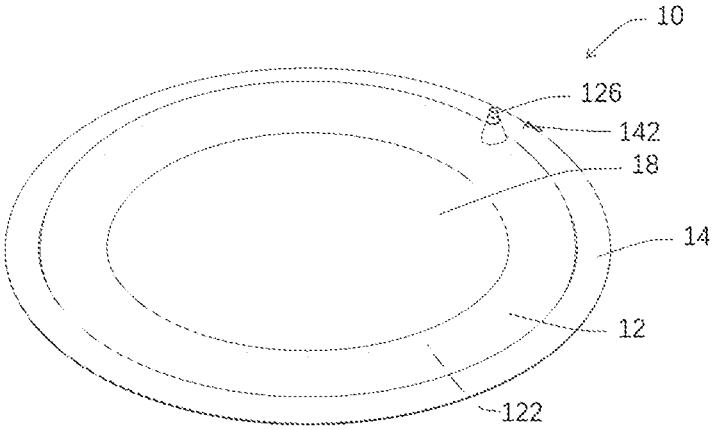
FIG. 1 is a schematic view of one embodiment of a portable water spraying device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

Figure 2:
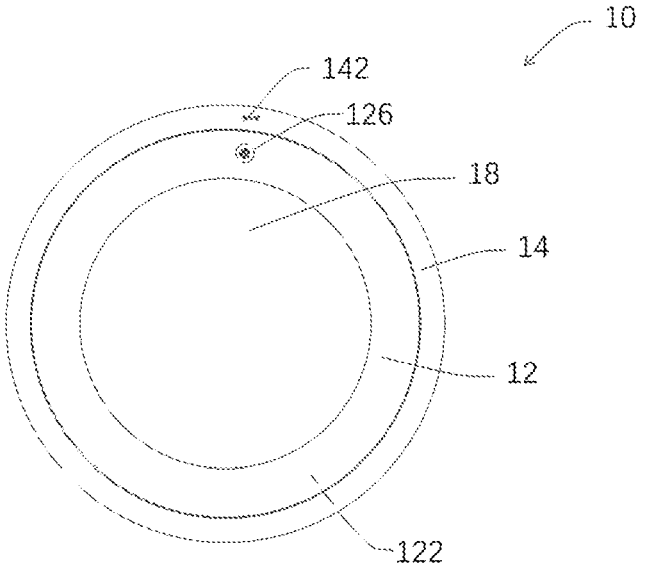
FIG. 2 is a front view of the portable water spraying device of FIG. 1.
Figure 3:
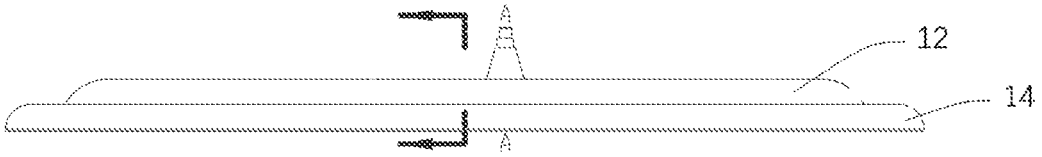
FIG. 3 is a lateral view of the portable water spraying device of FIG. 2.
Figure 4:
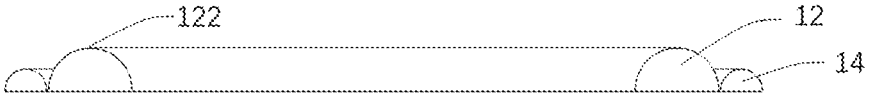
FIG. 4 is a cross-sectional view of the portable water spraying device of FIG. 3 as taken along the line A-A.
Figure 5:
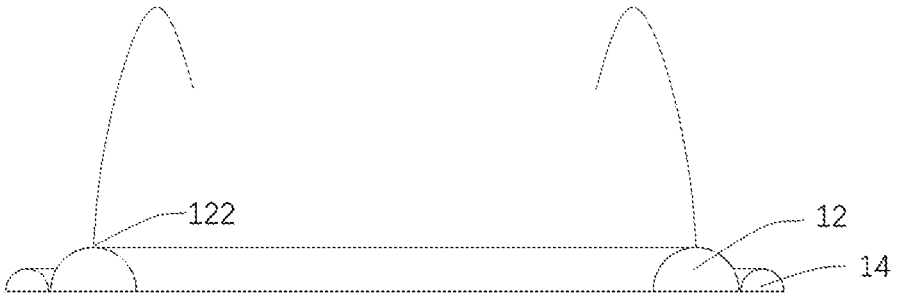
FIG. 5 is a view similar to that of FIG. 4, but where water is being sprayed out from the portable water spraying device.

As shown in FIG. 1 to FIG. 5, in one embodiment, a portable water spraying device 10 includes a water conduit 12 and a strut member 14.

The water conduit 12 defines an inflatable volume for receiving water. The water conduit 12 includes a water inlet valve 126 and a plurality of spray heads 122. The water conduit 12 is a ring. A cross-section of the water conduit 12 is substantially semicircular when the water conduit is filled with water. The plurality of spay heads 122 is arrayed at a top portion of the water conduit 12, and is spaced along a circular extension of water conduit 12. The water conduit 12 is advantageously made from plastic material and may include reinforcement material. When the water is pressured into the inflatable volume from the water inlet 126 and can be sprayed out form the plurality of spray heads 122.

The strut member 14 is located adjacent to the water conduit 12. The strut member 14 extends along an extension of the water conduit 12. The strut member 14 can keep the water conduit 12 stable when the water is pressured into the inflatable volume from the water inlet 126 and is sprayed out form the plurality of spray heads 122. The strut member 14 may be an air conduit. The air conduit can be inflatable. The air conduit is a ring around an outer side of the water conduit 12. A cross-section of the air conduit is substantially semicircular when the air conduit is filling with air.

A bottom of the water conduit 12 and a bottom of the air conduit are located at a same plane. A ratio of a diameter of the semicircular of the cross-section of the air conduit and a diameter of the semicircular of the cross-section of the water conduit 12 is about 1:2. The ratio about 1:2 is a proper ratio, which can provide well support to the water conduit 12. Water flow sprayed from the water conduit 12 can be deflected towards an inner side of the water conduit 12 as parabola-shaped. The ratio about 1:2 can keep the water flow from spraying towards a stable direction. The water flow cannot be deflected towards a lower direction due to flexible of the inner side of the water conduit, and the water flow cannot be deflected towards an outer side of the water conduit due to insufficient supporting force. The diameter of the semicircular of the cross-section of the air conduit is about 50 millimeters. The diameter of the semicircular of the cross-section of the water conduit 12 is about 100 millimeters. A diameter of each of the plurality of spray heads 122 is about 1 millimeter A distance between each spray head 122, and a joint line of the water conduit 12 and the air conduit is about 50 millimeters. The distance about 50 millimeters is the distance which the air conduit can provide proper supporting force to the plurality of spray heads 122.

Supporting force of the air conduit is centered at the joint line of the water conduit 12. The plurality of spray heads 122 is positioned within the radiation of support force of the air conduit. The supporting force of the air conduit can be moderation. The water flow cannot be over-deflected, such as towards a lower direction or towards an outer side of the water conduit.

The portable water spraying device is a household device, the water conduit can adapt hydrostatic pressure of household that is more than 40 PSI and less than 60 PSI. In one embodiment, the water conduit can adapt 50 PSI of hydrostatic pressure. The air conduit can adapt air pressure that is between 0.12 MPa and 0.24 MPa. The size of the water conduit 12 and the size of each of the plurality of spray heads 122 are defined according to the household hydrostatic pressure. A diameter of each of the plurality of spray heads 122 is about 1 millimeter, which can provide proper spray height of the water flow.

In the present embodiment, the water conduit 12 is liquid inflatable and is adapted to receive liquid under pressure. The air conduit is gas inflatable adapted to receive gas under pressure.

The portable water spraying device 10 further includes a floor 18 in an inner side of the water conduit 12 that also cooperates with the water conduit 12 to define an internal cavity or recess that is configured to hold water for swimming and/or bathing. The air conduit is positioned around the water conduit 12, adapted to support the water conduit 12. When the water is pressured into the water conduit 12 and is sprayed out form the plurality of spray heads 122, the flowing water in the inflatable volume can be stable.

In other embodiment, the strut member may be a strut water conduit, a strut pole, or other strut device for supporting the water conduit.

In the present embodiment, the air conduit is located around the water conduit. The air conduit can support from outer surrounding of the water conduit. Thus, an outer side of the water conduit is stabled and cannot be easily deformed. However, an inner side of the water conduit is suppled, water flow sprayed from the water conduit can be deflected towards an inner side of the water conduit. So that, all water flow from the plurality of spray heads can be sprayed towards a central of the water conduit and may fall to the floor. The water spraying device can be used as a small spray fountain. Even if the inner side of the water conduit is deformed or vibrated, the water flow can be still sprayed toward the inner side of the water conduit. The portable water spraying device has good compatibility, reliability, and stability. The water flow sprayed from the water conduit is parabola-shaped, and not irregular.

The embodiments shown and described above are only examples. Many details are often found in the art such as the other features of a system for generating picture thumbnail. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed as new and desired to be protected by Letters Patent, is:

1. A portable water spraying device, comprising:

a water conduit, defining an inflatable volume for receiving water, and comprising a water inlet valve and a plurality of spray heads, and the water inlet valve and the plurality of spray heads connecting to the inflatable volume; and a strut member, adjacent to the water conduit, extending along an extension of the water conduit;

wherein the strut member is capable of keeping the water conduit stable when the water is pressured into the inflatable volume from the water inlet and is sprayed out form the plurality of spray heads; the water conduit is a ring; a cross-section of the water conduit is substantially semicircular when the water conduit is filled with water; the plurality of spay heads is arrayed at a top portion of the water conduit, and is spaced along a circular extension of water conduit; the strut member comprises an air conduit, and the air conduit is inflatable; the air conduit is a ring around an outer side of the water conduit, and a bottom of the water conduit and a bottom of the air conduit are located at a same plane; a cross-section of the air conduit is substantially semicircular when the air conduit is filling with air; and a ratio of a diameter of the semicircular of the cross-section of the air conduit and a diameter of the semicircular of the cross-section of the water conduit is about 1:2.

2. The portable water spraying device of claim 1, wherein a diameter of the of the semicircular of the cross-section of the air conduit is about 50 millimeters, and a diameter of the semicircular of the cross-section of the water conduit is about 100 millimeters.

3. The portable water spraying device of claim 2, wherein a diameter of each of the plurality of spray heads is about 1 millimeter.

* * * * *